United States Patent [19]

Baumberger

[11] 3,977,508

[45] Aug. 31, 1976

[54] DEVICE FOR RECOGNIZING A CATEGORY OF COINS

[75] Inventor: Philippe Baumberger, Bourg la Reine, France

[73] Assignee: Compagnie Generale d'Automatisme, Paris, France

[22] Filed: June 2, 1975

[21] Appl. No.: 583,098

[30] Foreign Application Priority Data

June 19, 1974 France ..... 74.21262

[52] U.S. Cl. ..... 194/100 A; 194/102

[51] Int. Cl.² ..... G07F 3/02

[58] Field of Search ..... 104/100 A, 100 R, 102

[56] References Cited

UNITED STATES PATENTS

| | | | |
|---|---|---|---|
| 3,152,677 | 10/1964 | Phillips | 194/100 R |
| 3,561,580 | 2/1971 | Meloni | 194/100 A |
| 3,587,809 | 6/1971 | Meloni | 194/100 A |
| 3,749,220 | 7/1973 | Tabiichi et al. | 194/100 A |
| 3,901,368 | 8/1975 | Klinger | 194/100 A |

*Primary Examiner*—Allen N. Knowles

*Attorney, Agent, or Firm*—Haseltine, Lake & Waters

[57] ABSTRACT

Device for recognizing a category of coins making it possible to reject or accept coins by using measurement sensors having built-in magneto-resistances in a measuring bridge. A particular application can be found for the invention in toll devices for public highways.

3 Claims, 4 Drawing Figures

DEVICE FOR RECOGNIZING A CATEGORY OF COINS

The present invention has as its object a detector of coins.

Coins are distinguished from one another by the alloy of which they are made; by their geometrical characteristics: diameter, thickness; by their weight; impression, etc.

There are numerous devices for the automatic distribution of objects, whose operation is started up by the inserting of coins, these devices evidently comprising a device for recognizing the coins inserted in order to distribute the object only if the stated price has been paid by the inserting of coins whose value corresponds to that price.

In order to obtain an object of a certain price and with a view to simplifying the device for recognizing coins, it is not possible to insert coins at random until the sum corresponding to the stated price has been made up; it is necessary to use only a certain number of types of coins selected, rarely more than four in number, which can be recognized by the distribution device and, according to the systems used, it is either impossible to insert other coins or to have the device recognize them, the distribution system then not being started up and, in that case, either the coin is lost for the user or else a device enables the coin to be returned.

Of course, all the coin recognition devices are based on the recognizing of one or several of the above-listed characteristics of coins. These devices are often mechanical and sometimes electronic.

One aim of the invention is to produce a simple device having great speed of response in which the coins can pass very rapidly one behind another before the detecting device.

An application which affords a particular advantage having no limiting character, for toll stations on motorways can be found for the invention. It is indeed necessary in that application for the coins placed in a basket by the user be recognized as quickly as possible in order to keep the cars waiting for as short a time as possible.

A device for recognizing coins which comprises two electrical windings, the one for determining the substance of which the coin is made and the other for determining its diameter is known; it is therefore essential to have two windings and a complicated electronic device so that the indication given by one winding for a coin correspond effectively to the indication given by the other winding for that same coin when it passes before that other winding.

Moreover, the winding measuring the diameter does not give sufficiently accurate indications concerning the diameter of the coins to be able to dispense with the winding enabling the substance of which the coin is made to be determined.

The Applicant Company has, moreover, observed, on comparing a very great number of different coins from all countries, that it was extremely rare to find, among coins made of magnetic substances, two coins having exactly the same diameter.

The Applicant Company has therefore decided to manufacture a device making it possible to recognize coins made of a magnetic substance, based on an accurate recognition of the diameter. In practice, for France, the coins concerned are 50-centime bits, one-franc bits and the new issue of 5-franc bits. But of course, the device can be adjusted for any other foreign magnetic coins and, for example, Italian 50-lire and 100-lire bits.

The Applicant Company then thought of using sensors with magneto Such sensors, which are, for example, made of two magneto-resistances whose value varies as a function of the magnetic flux which crosses them, which are fixed onto a soft iron polar part on the front face constituting a pole of a permanent magnet, are known.

In known applications of these sensors: tachometers, angular position coders, pulse generators, etc., there is always a movement of a ferromagnetic coin before one of the magneto-resistances, then before the other, for example a linear movement in a direction parallel to the line which joins the centres of the two magneto-resistances, or a rotating movement in relation to an axis situated in a plane parallel to the plane formed by the front face of the permanent magnet and in that plane perpendicular to that direction, but never a linear movement perpendicular to that direction.

The present invention has as its object a device for recognizing a category of coins made of a ferromagnetic substance having a given diameter, characterized in that it comprises: means for guiding the coins along a line of a first plane, described by the end surface of the coins, these latter remaining parallel to the said plane, two magneto-resistances having a front face situated in a second plane parallel to the first plane and very close to each other, the said magneto-resistances which are very close to each other being centred in that second plane on a line drawn in the second plane, perpendicular to the line at one of its points, the two magneto-resistors being situated on a same side in relation to the said line and arranged along that perpendicular line in such a way that at the time of the passing of a coin belonging to the category to be recognized, it opens only one of the magneto-resistances, means for producing a constant magnetic field whose lines of force are perpendicular to the front faces of the said magneto-resistances, the said magneto-resistances constituting two branches of an electrical measurement bridge which is balanced when there are no coins, electronic means for measuring the unbalance of the said bridge at the time of the passing of a coin which provide an output signal called a control signal, when the unbalance of the bridge reaches a predetermined threshold.

According to a particular embodiment of the present invention, the device comprises, moreover, electronic means sending out a presence signal during the time when a coin passes before the magneto-resistance situated the nearest to the said line and means for forming an output signal when only one control signal has been emitted during the said presence signal.

An example of embodiment of the invention having no limiting character will be described with reference to the accompanying figures.

Figure 1:
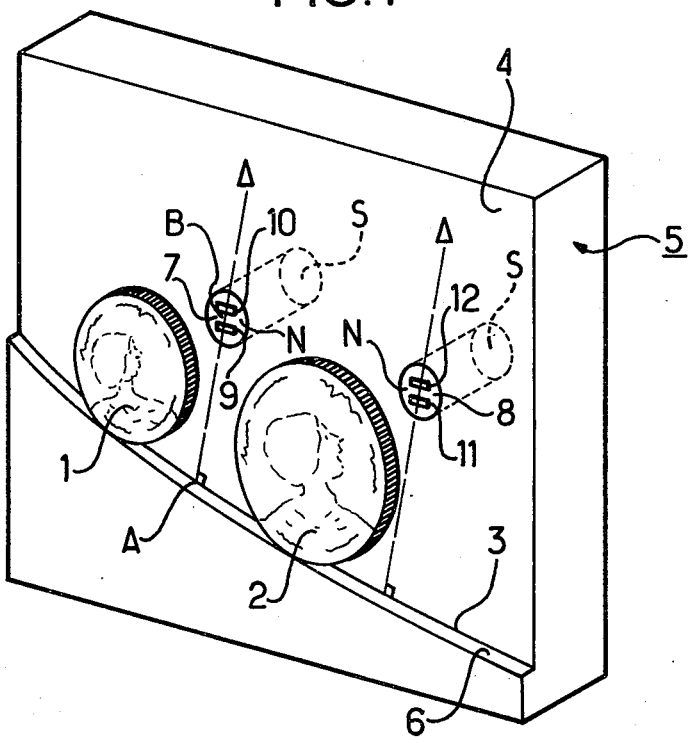
FIG. 1 shows a device according to the invention comprising two sensors with magneto-resistances, making it possible to select two different categories of coins.

The device according to the invention comprises, as can be seen in FIG. 1, means for guiding coins 1 and 2 along a line 3 of a plane 4. These guide means are materially shown by a solid block 5 whose front face 4 comprises a ledge 6 on which the coins 2 and 1 rest on their end surfaces. The intersection of that ledge 6 with the face 4 of the block 5 is a curved line 3 going down from the left towards the right in the figure.

Two sensors 7 and 8 with magneto-resistances are inserted inside the block 5. The sensors are, for example, constituted by two magneto-resistances: 9 and 10 for the sensor 7 and 11 and 12 for the sensor 8, fixed on the front face, having a North polarity, for example, referenced by the letter N in the figure, of a cylindrical permanent magnet. These magneto-resistances have, for example, the shape of a small cylindrical or rectangular bar, or, even, the shape of a pellet. The sensors can also consist of two magneto-resistances having the shape of two small bars with a square, rectangular or cylindrical cross-section placed inside a permanent magnet in the shape of a stove pipe one of whose ends is polarized North and the other South, the space comprised between the magnet and the magneto-resistances being filled in by a filling substance.

The magneto-resistances are therefore crossed by the lines of force of a constant magnetic field, perpendicular in relation to their faces situated in a plane perpendicular to the axis of the magnet.

The magneto-resistances are thus crossed by a magnetic flux $\phi = \mu$ HS, S being the cross-section of the magneto-resistances perpendicular to the lines of force of the field; H being the intensity of the magnetic field and $\mu$ being the average magnetic permeability of the magnetic circuit.

If a ferromagnetic substance is inserted in the path of the lines of force of the magnetic field of a magneto-resistance, the average magnetic permeability of that circuit increases, that is, $\mu$ therefore the magnetic flux $\phi$ through the magneto-resistance in which the value of the resistance then increases.

These sensors 7 and 8 are placed inside the block 5 in such a way that the front face of the magneto-resistances 9, 10, 11 and 12 are very slightly set back in relation to the plane face 4 of the block 5 in such a way that there is no rubbing of the coins 1 and 2 against the magneto-resistances when they pass before the sensors 7 and 8. Moreover, the sensors 7 and 8 are directed, inside the block 5, in such a way that the magneto-resistances of a same sensor be centred one above the other on a same line $\Delta$ perpendicular to the line 3 at one of its points. The sensors 7 and 8 are adjustable for position along the straight line $\Delta$ by means of any device which is very simple and well-known, not shown, which consists in accomodating the sensors 7 and 8 in oblong holes drilled in the block 5 and in fixing the sensors in the required position.

The adjusting of that position depends, for each sensor, on the category of coins which are required to be selected and the adjusting is such that the distance AB, separating the middle of the distance separating the two magneto-resistances, for the point A of meeting of the straight line $\Delta$ with the line 3, be very substantially equal to the diameter of the category of coins to be recognized. The adjusting of that position is effected moreover, by placing the magneto-resistances such as 9 and 10 in a measuring bridge balanced, at the outset, then a coin of the category which it is required to recognize is placed against the plane 4 and rests on the ledge 6, placing the point of contact of the coin with the ledge at the point A and the sensor 7 is then moved along the straight line $\Delta$ inside the oblong hole in which it is situated, fixing it at the point at which the maximum unbalance of the bridge is obtained. Experience shows, as is natural, moreover, that this result is obtained when the sensor is placed as has been said hereinabove. It is possible to find the curve of unbalance of the bridge as a function of the position of the sensor in relation to the coin, a very pointed curve is obtained, this meaning that if there is a coin of a different category, having a diameter which is not very different from the coin for which the adjustment was made, the point which is significant of the unbalance of the bridge on the said curve will be relatively far from the maximum and that it is possible therefore to select a threshold on that curve and to decide that a coin will be valid if, passing before the sensor, the unbalance of the bridge is such that it exceeds the threshold and non-valid in the contrary case. In the example given in FIG. 1, there are two sensors; the one can, for example, be adjusted for a 50-centime bit and the other for a 1-franc bit.

Figure 2:
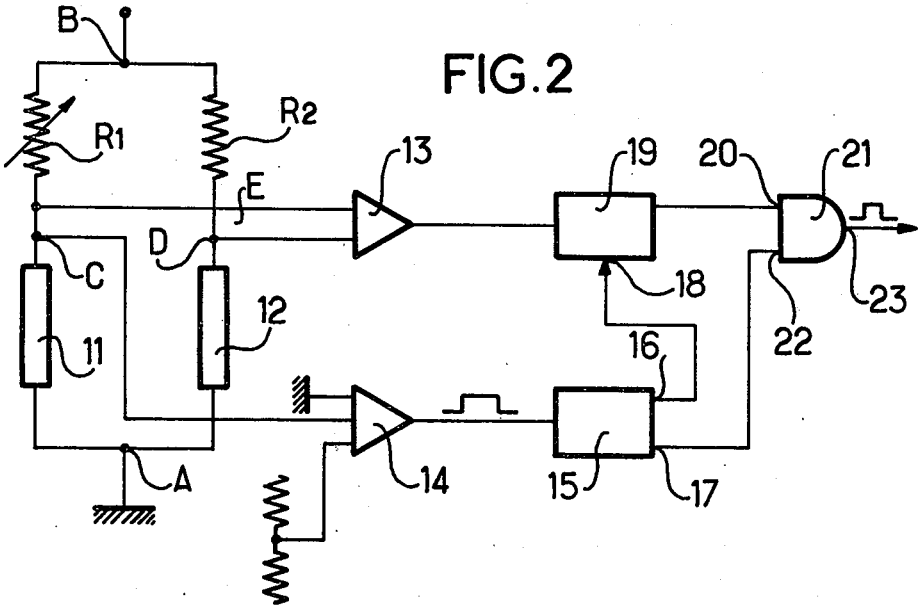
FIG. 2 shows a diagram of the electronic circuit connected with the magneto-resistances.

FIG. 2 shows the electronic detection device connected with each sensor.

Taking, for example, the device connected with the sensor 8 having magneto-resistances;

The magneto-resistances 11 and 12 constitute two branches of an electrical measuring bridge whose other two branches are constituted by resistances R1 and R2, the resistance R1 being variable in order to adjust the bridge. The latter is adjusted to be balanced when there are no coins before the sensor. The bridge is, for example, fed with a 5 volt tension in the first diagonal between the points A and B. In the balanced state, the voltage E is zero in the other diagonal between the points C and D. The device comprises two channels: a measuring channel and a coin presence channel.

The measuring channel comprises a comparator 13 which is connected in the second diagonal between the points C and D; it compares the unbalance voltage between the points C and D with a threshold voltage which has been selected. The comparator 13 sends out a signal at its output when that threshold voltage is reached or exceeded at the time of the passing of a coin before the sensor 8. This could be sufficient if it was sure that it would be possible to insert in the device only the coins for which the position of the sensor 8 on the right has been adjusted and coins having a smaller diameter, this possibly being the case when the coins are inserted in calibrated slots, but that is not sufficient if it is possible to insert coins having a larger diameter than the coins for which the sensor has been adjusted, for then, as will be seen hereinbelow during the description of FIG. 3, the threshold will be reached twice and the comparator will supply to the output two signals for a single coin whereas a single coin and, what is more, not the valid coin will have passed.

That is why the device comprises a presence channel which comprises a comparator 14 comparing the voltage of the point C with a threshold voltage whose value is very slightly greater than the voltage of the point C when the bridge is balanced. That comparator sends out therefore a signal each time that threshold is reached and throughout the duration of the exceeding of the threshold. The output of the comparator 14 is connected to a differentiator 15 having two outputs the first of which 16 receives the rising wave fronts and the second of which 17 receives the descending wave fronts of the signals formed by the comparator 14. The first output 16 of the differentiator 15 is connected to a terminal 18 for resetting to zero a bistable element 19 whose input is connected to the output of the comparator 13 of the measuring channel and whose output is connected to a first input 20 of a logic AND element 21 whose second input 22 is connected to the second output 17 of the differentiator 15. The logic AND element 21 thus sends out, at its output 23, a signal, if the comparator 13 of the measuring channel has sent out a signal and only one signal, throughout the duration of the presence signal sent out by the comparator 14 of the presence channel. If a coin smaller than that for which the sensor has been adjusted passes before that sensor, the comparator 13 will supply no signal and hence the bistable element 19 will remain at 0 and the AND gate 21 will remain closed and if a coin larger than that for which the sensor has been adjusted passes before that sensor, the comparator 13 will supply signals, therefore the bistable element will change over to the state "1" at the first signal and will return to the state "0" at the second signal and there again, the AND gate 21 will remain closed.

Figure 3:
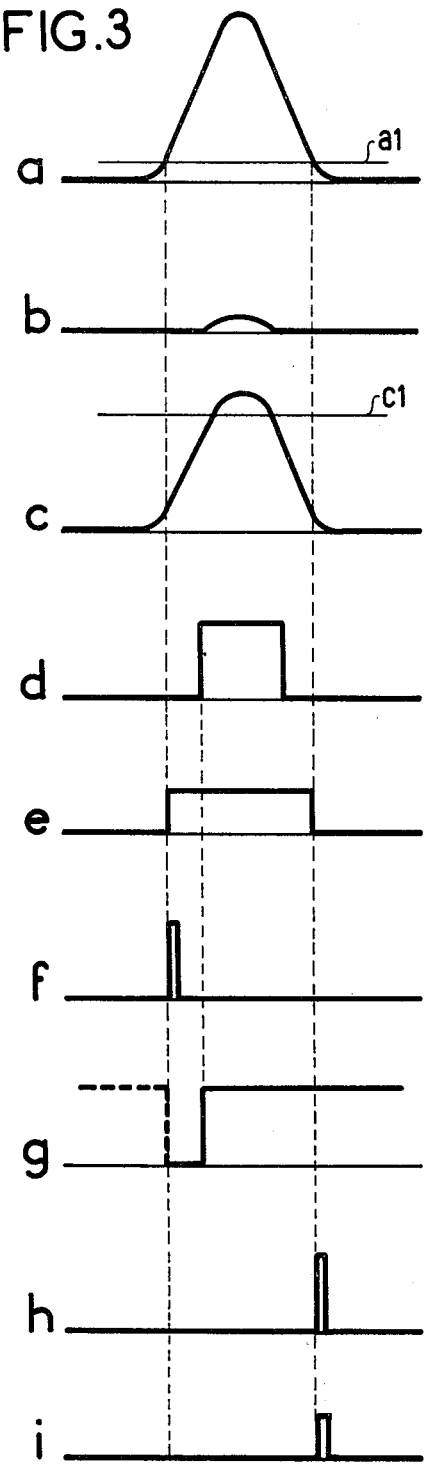
FIG. 3 shows a graph of various signals sent out by the various elements shown in FIG. 2 in the case of the passing of a valid coin.

FIG. 3 shows the signals sent out by the various devices in the case of the passing of a valid coin before a sensor.

The variation in the value of the voltage at the terminals of the magneto-resistance 11 when a valid coin passes before the sensor 8 will be seen on the line *a*. The line $a_1$ represents the threshold voltage which has been imposed on the comparator 14 of the presence channel.

The variation in the value of the voltage at the terminals of the magneto-resistance 12 on the passing of the coin will be seen on the line *b*. That variation is very slight since the sensor is adjusted so that the coin does not cover the magneto-resistance 12 on passing.

The variation in the value of the voltage E between the points C and D on the passing of the coin is shown on the line *c*. That voltage E is a function of the difference in the values of the resistances of the magneto-resistances 11 and 12. This diagram shows the line $C_1$ which shows the threshold voltage which is imposed on the comparator 13 of the measuring channel 13.

The signal sent out by the measuring comparator 13 when the threshold $C_1$ is crossed is shown on the line E.

The signal sent out by the presence comparator 14 when the threshold $A_1$ is crossed is shown on the line *e*.

The rising pulse supplied by the differentiator 15 and used for resetting the flip-flop 19 to 0 is shown on the line *f*.

The changing over of the flip-flop 19 from the state 0 to the state 1 is shown on the line *g*, the output of the flip-flop being connected to the input 20 of the logic AND element 21.

The descending (return) pulse supplied by the differentiator 15 at the time of the end of the presence signal (*e*) is shown on the line *h*, that pulse being sent on the input 22 of the logic AND element 21.

The coin recognition pulse sent out of the logic AND element 21 which receives the signals from the lines *g* and *h* is shown on the line *i*.

Figure 4:
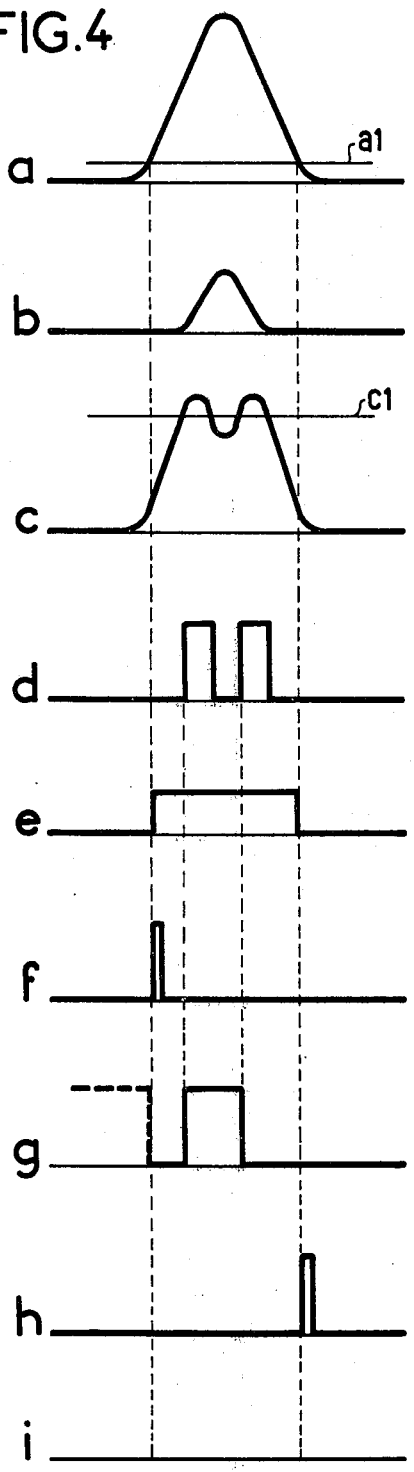
FIG. 4 shows the same signals in the case of the passing of a coin which is too big.

FIG. 4 shows, on the same lines, the signals supplied by the same elements in the case of a coin which is too large, covering, for example, partly, the magneto-resistance 12. It will be seen that the logic AND element 21 does not supply any output signal (line *i*).

If the coin is very much greater than required, there will still be a camel's back signal (line *c*), but the apexes will no longer exceed even the threshold $C_1$; therefore there will be no difficulties. If the coin is too small, evidently, the threshold $C_1$ is not reached.

I claim:

1. A device for recognizing a category of coins of ferromagnetic substance and having a given diameter, comprising, in combination, means for guiding the coins along a line of a first plane, defined by the circumference of the coins, said coins remaining parallel to said plane, two magneto-resistances having a front face arranged in a second plane parallel to said first plane, said magneto-resistances being substantially close to each other, said magneto-resistances being centered in said second plane on a line in said second plane, and perpendicular to said first-mentioned line at one point, the two magneto-resistances being located on a same side in relation to said first-mentioned line and arranged along the second-mentioned perpendicular line so that at the time of passing of a coin belonging to the category to be recognized, it covers only one of the magneto-resistances, means for producing a constant magnetic field whose lines of force are perpendicular to the front faces of the said magneto-resistances, said magneto-resistances comprising two branches of an electrical measurement bridge which is balanced when there are no coins, electronic means for measuring the unbalance of the said bridge at the time of the passing of a coin and providing an output control signal, when the unbalance of the bridge reaches a predetermined threshold.

2. A device for recognizing a category of coins according to claim 1, including electronic means providing a presence signal during the time when a coin passes before the magneto-resistance situated nearest to said first line and means for forming an output signal when only one control signal has been emitted during said presence signal.

3. A device for recognizing a category of coins according to claim 2, wherein said means sending out said presence signal comprises a comparator comparing the voltage at the terminals of the magneto-resistance which is nearest to said first line with a threshold voltage exceeding substantially the voltage at the terminals of said magneto-resistance when the bridge is balanced, said means for forming of an output signal when only one control signal has been emitted throughout the duration of said presence signal comprising a bistable element connected to said control signal, said bistable element comprising a terminal for resetting to the state 0 and controlled by the rising wave front of the present signal, an AND gate, and an output terminal connected to one input, said AND gate having a second input controlled by the descending wave front of the presence signal.

* * * * *